US006362154B1

(12) United States Patent
Moeller et al.

(10) Patent No.: US 6,362,154 B1
(45) Date of Patent: Mar. 26, 2002

(54) MULTIPHASE CLEANING COMPOSITION CONTAINING NAPHTHALENE SULFONIC ACID/FORMALDEHYDE CONDENSATE

(75) Inventors: Thomas Moeller, Duesseldorf; Heinz-Dieter Soldanski, Essen; Stefanie Kuech, Ratingen; Juergen Noglich, Duesseldorf, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/469,814

(22) Filed: Dec. 22, 1999

(30) Foreign Application Priority Data

Dec. 23, 1998 (DE) ..... 198 59 778

(51) Int. Cl.[7] ..... C11D 1/12

(52) U.S. Cl. ..... 510/417; 510/180; 510/181; 510/245; 510/432

(58) Field of Search ..... 510/432, 188, 510/475, 461, 476, 361, 284, 276, 516, 480, 513, 417, 180, 181, 245; 252/388, 8.61, 608, 401; 424/497, 419; 8/675, 552; 514/132, 122; 134/2, 22.19

(56) References Cited

U.S. PATENT DOCUMENTS

| | | | | |
|---|---|---|---|---|
| 3,696,043 A | | 10/1972 | Labarge | |
| 3,839,234 A | | 10/1974 | Roscoe | |
| 3,882,038 A | | 5/1975 | Clayton et al. | |
| 4,302,348 A | * | 11/1981 | Requejo | 252/135 |
| 4,863,524 A | * | 9/1989 | Komabashiri et al. | 134/22.19 |

FOREIGN PATENT DOCUMENTS

| | | |
|---|---|---|
| CA | 1 334 173 | 1/1995 |
| DE | 22 20 540 | 11/1973 |
| DE | 39 10 170 | 10/1989 |
| DE | 195 01 184 | 7/1996 |
| DE | 195 01 187 | 7/1996 |
| DE | 19501 188 | 7/1996 |
| EP | 0 195 336 | 9/1986 |
| EP | 39 10 170 | 10/1989 |
| EP | 0 344 847 | 12/1989 |
| EP | 0 393 772 | 10/1990 |
| WO | WO96/04359 | 2/1991 |
| WO | WO97/33963 | 9/1997 |
| WO | WO97/38076 | 10/1997 |

OTHER PUBLICATIONS

Derwent Patent Abstract (WPAT) No. 1972–63174T [40].
Derwent Patent Abstract (WPAT) No. 1986–252816 [39 ].
Derwent Patent Abstract (WPAT) No. 1996–334670 [34].
Derwent Patent Abstract (WPAT) No. 1996–334672 [34].
Derwent Patent Abstract (WPAT) No. 1996–334673 [34].

* cited by examiner

*Primary Examiner*—Yogendra N. Gupta
*Assistant Examiner*—Gregory E. Webb
(74) *Attorney, Agent, or Firm*—Glenn E. J. Murphy

(57) ABSTRACT

Naphthalene sulfonic acid/formaldehyde condensates may be used (i) in a liquid multiphase cleaning composition with at least two continuous phases which contains at least one aqueous phase I and a non-aqueous liquid phase II immiscible with this aqueous phase and which can be temporarily converted into an emulsion by shaking, (ii) in a composition for cleaning hard surfaces to reduce the rain effect and/or the film effect, (iii) in a process for reducing the rain effect and/or the film effect on a hard surface treated with a liquid cleaning composition, the surface being treated with a liquid cleaning composition in concentrated or diluted form containing at least one naphthalene sulfonic acid/formaldehyde condensate and (iv) in a process for cleaning hard surfaces, more particularly glass, in which a cleaning composition according to (i) is temporarily converted into an emulsion by shaking, applied to the surface to be cleaned, preferably by spraying, in quantities of 1.5 to 10 g per $m^2$ and the surface is then optionally cleaned by wiping with a soft absorbent material.

57 Claims, No Drawings

MULTIPHASE CLEANING COMPOSITION CONTAINING NAPHTHALENE SULFONIC ACID/FORMALDEHYDE CONDENSATE

BACKGROUND OF THE INVENTION

1. Field of the Invention

This invention relates to multiphase, liquid cleaning compositions containing naphthalene sulfonic acid/formaldehyde condensate which can be temporarily emulsified by shaking and which may be used for cleaning hard surfaces, more particularly glass, and to a process for cleaning hard surfaces.

2. Discussion of Related Art

The cleaning compositions typically used nowadays for cleaning hard surfaces are generally aqueous preparations in the form of a stable solution or dispersion which contain surfactants, organic solvents and optionally complexing agents for the hardness constituents of water, abrasives and alkalis with a cleaning effect as their key active ingredients. Cleaning compositions intended above all for cleaning glass and ceramic surfaces are often formulated as solutions of the active ingredients in a mixture of water and water-miscible organic solvents, primarily lower alcohols and glycol ethers. Examples of such compositions can be found in DE-OS 22 20 540, in U.S. Pat. Nos. 3,389,234 and 3,882,038 and in European patent applications 344 847 and 393 772.

So far as their practical application is concerned, the cleaning compositions are expected to combine high cleaning performance with simple and convenient application. In most cases, the compositions are expected to develop the required effect after a single application, i.e. in the absence of further measures. Difficulties arise here—above all where the compositions are applied to smooth surfaces, particularly to reflective surfaces, such as glass or ceramic surfaces—out of the fact that compositions which have a favorable cleaning performance generally do not dry without leaving streaks while compositions which dry largely without any visible residues have only a limited cleaning effect. In order to combine an adequate cleaning effect, particularly against fatty soils, with acceptable residue behavior, relatively large quantities of more or less volatile alkalis have to be added to the cleaning compositions in addition to organic solvents. Ammonia and alkanolamines in particular have been used for this purpose. Unfortunately, relatively high concentrations of ammonia or amine—apart from the strong odors they emit—produce a corresponding increase in the pH value of the cleaning solution with the result that relatively sensitive surfaces, for example paint surfaces, are clearly attacked by these cleaning compositions.

In addition, smooth surfaces, particularly reflective surfaces, such as glass or ceramic surfaces, present two particular problems which generally do not come to light immediately after cleaning, but only at a later stage. The first problem is the well-known, but problematical phenomenon of the condensation of water onto the surfaces mentioned, for example in bathrooms during and after showering or bathing, which is referred to hereinafter as the film effect. The second problem is the phenomenon as well-known as it is unwelcome—although unavoidable in the long term—that, after the cleaning of a reflective surface exposed to the weather, such as window glass, a shower of rain destroys the cleaning result through the rain marks it leaves behind, which is referred to hereinafter as the rain effect.

Accordingly, there is still a need for cleaning compositions which have a high cleaning performance without any of the disadvantages mentioned above.

DE-OS 39 10 170 describes mouth-wash compositions for desorbing bacteria from hard surfaces and living tissue which are present in the form of a two-phase preparation and which can be converted by shaking into a temporary oil-in-water emulsion, the aqueous phase making up about 50 to 97% by weight and the water-immiscible oil phase about 3 to 50% by weight. Crucial to the invention is the presence of about 0.003 to 2% by weight of an amphiphilic cationic agent, for example a cationic surfactant, in a quantity which allows the formation of the oil-in-water emulsion, this emulsion collapsing and separating about 10 seconds to 30 minutes after its formation. Anionic surfactants impair the antibacterial action. Other surfactants are not mentioned.

European patent application 0 195 336 describes in two embodiments (1) and (2) compositions emulsifiable by shaking for the care of sensitive surfaces, more particularly (1) plastic surfaces and (2) compact discs, which—besides an aqueous phase—contain an organic phase consisting of the chlorofluorocarbon (CFC) 1,1,2-trichloro-1,2,2-trifluoroethane. In addition, the compositions are wax-free and contain in the aqueous phase (1) at least one surfactant and a water-soluble liquid silicone oil and (2) the triethanolamine salt of a $C_{10-12}$ alkyl sulfuric acid semiester. The stability of the emulsion that can be formed by shaking is not discussed. In order to guarantee emulsifiability, the surfactant content is normally between 1 and 10% by weight, preferably between 2 and 8% by weight and, if necessary, even above 10% by weight, anionic surfactants—particularly those containing a sulfate or sulfonate group—being preferred. However, the use of CFCs should be reduced or, better still, avoided altogether in view of their environmentally harmful properties, particularly in connection with the ozone hole.

DE-OSS 195 01 184, 195 01 187 and 195 01 188 (Henkel KGaA) relate to hair treatment compositions in the form of a two-phase system containing an oil phase and a water phase, the oil phase preferably being based on silicone oil and being mixable in a short time by mechanical action.

WO 96/04358 A1 (Procter & Gamble) describes cleaning compositions which are capable of cleaning glass without leaving behind any troublesome stains and/or films and which contain an effective quantity of a substantive polymer containing hydrophilic groups which provides the glass with relatively high and long-lasting hydrophilia, so that, the next three times at least the glass is wetted, for example by rain, the water drains from the glass surface and few stains are left behind after drying. Substantive polymers are, in particular, polycarboxylates, such as poly(vinyl pyrrolidone-co-acrylic acid), but also poly(styrene sulfonate), cationic sugar and starch derivatives and block copolymers of ethylene oxide and propylene oxide, the latter polyethers in particular having relatively little substantivity.

Accordingly, the problem addressed by the present invention was to provide high-performance, storage-stable and easy-to-handle compositions for cleaning hard surfaces which would show separate phases, which could be converted into an emulsion for application, which would remain homogeneous during application and would then revert to separate phases and which, after application to the hard surface, would counteract the rain effect and the film effect, i.e. would develop an anti-rain effect and an anti-film effect.

DESCRIPTION OF THE INVENTION

In a first embodiment, the present invention relates to a liquid multiphase cleaning composition with at least two continuous phases which contains at least one aqueous phase I and a non-aqueous liquid phase II immiscible with this aqueous phase, which can be temporarily converted into an emulsion by shaking and which contains at least one naphthalene sulfonic acid/formaldehyde condensate.

In the context of the present invention, the expression immiscible non-aqueous phase means a phase not based on water as solvent, although small quantities, based on non-aqueous phase II, of water of up to 10% by weight and normally not more than 5% by weight may be dissolved in the non-aqueous phase II.

In the most simple case, a composition according to the invention comprises a continuous aqueous phase consisting of the entire phase I and a continuous non-aqueous liquid phase consisting of the entire phase II. However, one or more continuous phases of a composition according to the invention may also contain parts of another phase in emulsified form, so that in a composition such as this part of phase I for example is present as continuous phase I, which represents the continuous aqueous phase of the composition, while another part is emulsified as discontinuous phase I in the continuous non-aqueous phase II. The same applies to phase II and other continuous phases.

In a second embodiment, the present invention relates to the use of at least one naphthalene sulfonic acid/formaldehyde condensate in a multiphase composition for cleaning hard surfaces to reduce the rain effect and/or the film effect.

In a third embodiment, the present invention relates to a process for reducing the rain effect and/or the film effect on a hard surface treated with a liquid cleaning composition, characterized in that the surface is treated with a liquid cleaning composition in concentrated or diluted form containing at least one naphthalene sulfonic acid/formaldehyde condensate.

The present invention also relates to a process for cleaning hard surfaces, more particularly glass, in which a cleaning composition according to the invention is temporarily converted into an emulsion by shaking, applied to the surface to be cleaned, preferably by spraying, in quantities of 1.5 to 10 g per $m^2$ and the surface is then optionally cleaned by wiping with a soft absorbent material.

A particular advantage of the present invention is that both an anti-rain effect and an anti-film effect are developed through the naphthalene sulfonic acid/formaldehyde condensates according to the invention.

The compositions according to the invention are distinguished not only by their high cleaning performance, but also by their overall high stability in storage. Thus, the individual phases in the composition are stable in storage for long periods, i.e. for example do not form any deposits, and the conversion into a temporary emulsion remains reversible, even after frequent shaking. Also, the physical form of the compositions according to the invention avoids the problem of having to stabilize a composition formulated as an emulsion per se. In addition, the separation of ingredients into separate phases can promote the chemical stability of the composition. Moreover, the compositions according to the invention show excellent residue behavior. Greasy residues are largely avoided so that the surfaces retain their shine without any need for subsequent rinsing.

The content of at least one naphthalene sulfonic acid/formaldehyde condensate in the composition according to the invention is normally from 0.001 to 20% by weight, preferably from 0.01 to 10% by weight, more preferably from 0.05 to 5% by weight, most preferably from 0.1 to 1.5% by weight and, in one particularly advantageous embodiment, from 0.15 to 0.5% by weight.

Naphthalene sulfonic acid/formaldehyde condensates are polycondensation products of naphthalene sulfonic acid and formaldehyde which may be obtained by known methods of alkaline or acidic condensation.

In the context of the present invention, the term naphthalene sulfonic acid/formaldehyde condensate encompasses the naphthalene sulfonate/formaldehyde condensates, i.e. the salts of the naphthalene sulfonic acid/formaldehyde condensates. Suitable salts are, for example, the alkali metal and alkaline earth metal salts, preferably the sodium, potassium, magnesium and calcium salts and the ammonium salts of the naphthalene sulfonic acid/formaldehyde condensates or mixtures thereof, more particularly the sodium salts.

Both high molecular weight and low molecular weight naphthalene sulfonic acid/formaldehyde condensates are suitable for the purposes of the invention, the low molecular weight condensates being marginally preferred.

Naphthalene sulfonic acid/formaldehyde condensates suitable for he purposes of the invention are commercially obtainable, for example under the name of Lomar® from Henkel Corp., for example the low molecular weight sodium salts Lomar® LS, Lomar® PW, Lomar® PWFA 40 and Lomar® PL 4, the high molecular weight sodium salts Lomar® D and Lomar® D SOL, the potassium salt Lomar® HP and the ammonium salt Lomar® PWA, and under the name of Tamol® from BASF AG, for example the low molecular weight condensates Tamol® NN 2901, Tamol® NN 7718, Tamol® NN 8906, Tamol® NN 9104, Tamol® NN 9401 (all sodium salts) and Tamol® NNA 4109 (ammonium salt) with a molecular weight of about 6,500 g/mole, the medium molecular weight condensates Tamol® NMC 4001 and Tamol® NN 9401 (both calcium salts) with a molecular weight of about 20,000 g/mole and the high molecular weight condensates Tamol® NH 3091, Tamol® NH 7519, Tamol® NH 9103 (all sodium salts) and Tamol® NHC 3001 (calcium salt) with an average molecular weight of about 35,000 g/mole.

In one particular embodiment of the invention, the composition is substantially CFC-free, i.e. the non-aqueous liquid phase II is not based on CFCs. The compositions according to the invention preferably contain no CFCs at all in view of their adverse effect on the environment, although small quantities, based on the composition as a whole, of up to about 5% by weight are tolerable.

In one preferred embodiment of the invention, the continuous phases I and II are demarcated from one another by a sharp interface.

In another preferred embodiment of the invention, one or both of the continuous phases I and II contain parts, preferably 0.1 to 35% by volume and more preferably 0.2 to 20% by volume, based on the volume of the particular continuous phase, of the other phase as dispersant. Accordingly, the continuous phase I or II is reduced by that part by volume which is distributed as dispersant in the other phase. Particularly preferred compositions are characterized in that phase I is emulsified in phase II in quantities of 0.1 to 35% by volume and preferably in quantities of 0.2 to 20% by volume, based on the volume of phase II.

Another preferred embodiment of the invention is characterized in that, besides the continuous phases I and II, part of the two phases is present as an emulsion of one of the two phases in the other phase, this emulsion being demarcated by two sharp interfaces, namely an upper interface and a lower interface, from the other parts of phases I and II which are not involved in the emulsion.

The compositions according to the invention preferably contain 5 to 95% by volume of phase I and 95 to 5% by volume of phase II.

In another preferred embodiment of the invention, the composition contains 35 to 95% by volume of phase I and 5 to 65% by volume of phase II, more preferably 55 to 95% by volume of phase I and 5 to 45% by volume of phase II and most preferably 70 to 95% by volume of phase I and 5 to 30% by volume of phase II. In addition, the continuous phase 1 preferably represents the lower phase while the continuous phase II represents the upper phase.

In another preferred embodiment of the invention, the water-immiscible phase II is based on aliphatic gasoline hydrocarbons and/or terpene hydrocarbons. The gasoline hydrocarbons have a boiling point range of preferably 130 to 260° C., more preferably 140 to 240° C. and most preferably 150 to 220° C., such as the $C_{9-13}$ isoparaffins with a boiling point range of 184 to 217° C. obtainable, for example, as Shellsol® T from Deutsche Shell Chemle AG (Eschborn). Suitable terpene hydrocarbons are, for example, citrus oils such as the orange oil obtained from the peel of oranges, the orange terpenes—particularly limonene—present therein or pine oil extracted from roots and stubs. Phase II may also consist entirely of aliphatic gasoline hydrocarbons and/or terpene hydrocarbons. In this case, phase II contains gasoline hydrocarbons in quantities of preferably at least 60% by weight, more preferably 90 to 99.99% by weight, most preferably 95 to 99.9% by weight and, in one particularly advantageous embodiment, 97 to 99% by weight.

Suitable surface-active substances for the compositions according to the invention are surfactants, more particularly from the classes of anionic and nonionic surfactants. The compositions preferably contain anionic and nonionic surfactants, the anionic surfactants being present in particular in phase I. The quantity of anionic surfactant, based on phase I, is normally not more than 10% by weight, preferably between 0.01 and 5% by weight, more preferably between 0.01 and 0.5% by weight and most preferably between 0.1 and 0.3% by weight. Where the compositions contain nonionic surfactants, their concentration preferably in phase I, based on phase I, is normally no higher than 3% by weight, preferably between 0.001 and 0.3% by weight and more preferably between 0.001 and 0.1% by weight, and in phase II, based on phase II, normally no higher than 5% by weight, preferably between 0.001 and 0.5% by weight, more preferably between 0.001 and 0.2% by weight, most preferably between 0.005 and 0.1% by weight and, in one particularly advantageous embodiment, between 0.01 and 0.05% by weight.

Preferred anionic surfactants are $C_{8-18}$ alkyl benzenesulfonates, more particularly containing about 12 carbon atoms in the alkyl moiety, $C_{8-20}$ alkane sulfonates, $C_{8-18}$ monoalkyl sulfates, $C_{8-18}$ alkyl polyglycol ether sulfates containing 2 to 6 ethylene oxide units (EO) in the ether moiety and sulfosuccinic acid esters containing 8 to 18 carbon atoms in the alcohol moieties.

The anionic surfactants are preferably used as sodium salts, although they may also be present as other alkali metal or alkaline earth metal salts, for example magnesium salts, and in the form of ammonium or amine salts.

Examples of such surfactants are sodium cocoalkyl sulfate, sodium sec.-alkane sulfonate containing about 15 carbon atoms and sodium dioctyl sulfosuccinate. Fatty alkyl sulfates containing 12 to 14 carbon atoms and sodium lauryl ether sulfate containing 2 EO have proved to be particularly suitable.

The nonionic surfactants used include, above all, $C_{8-18}$ alcohol polyglycol ethers, i.e. ethoxylated alcohols containing 8 to 18 carbon atoms in the alkyl moiety and 2 to 15 ethylene oxide units (EO), $C_{8-18}$ carboxylic acid polyglycol esters containing 2 to 15 EO, ethoxylated fatty acid amides containing 12 to 18 carbon atoms in the fatty acid moiety and 2 to 8 EO, long-chain amine oxides containing 14 to 20 carbon atoms and long-chain alkyl polyglycosides containing 8 to 14 carbon atoms in the alkyl moiety and 1 to 3 glycoside units. Examples of such surfactants are oleyl/cetyl alcohol containing 5 EO, nonylphenol containing 10 EO, lauric acid diethanolamide, cocoalkyl dimethyl amine oxide and cocoalkyl polyglucoside containing on average 1.4 glucose units.

Besides the addition products of ethylene oxide and fatty alcohols containing in particular 4 to 8 ethylene oxide units, preferred nonionic surfactants in the aqueous phase are the alkyl polyglycosides, of which those containing 8 to 10 carbon atoms in the alkyl moiety and up to 2 glucose units are preferred. Particularly preferred nonionic surfactants in the non-aqueous phase II are fatty alcohol polyglycol ethers containing in particular 2 to 8 EO, for example oleyl/cetyl alcohol +5 EO ether, and/or fatty acid polyglycol esters (FAE) with in particular 2 to 10 EO, for example tallow fatty acid +6EO ester. In addition, in the nonionic surfactants, particularly the alcohol polyglycol ethers and carboxylic acid polyglycol esters, for phase II, the degree of ethoxylation is adapted to the C chain length in such a way that shorter C chains are combined with relatively low degrees of ethoxylation and longer C chains with relatively high degrees of ethoxylation.

Particularly preferred compositions contain anionic and nonionic surfactant. Combinations of anionic surfactant in phase I and nonionic surfactant in phase II, for example combinations of fatty alkyl sulfates and/or fatty alcohol polyglycol ether sulfates in phase I with fatty alcohol polyglycol ethers and/or FAE in phase II, are particularly advantageous.

The cleaning compositions according to the invention may additionally contain water-soluble organic solvents in the form of lower alcohols and/or ether alcohols, but preferably mixtures of alcohols and ether alcohols. The quantity of organic solvent is preferably between 0.1 and 15% by weight and more preferably between 1 and 10% by weight, based on aqueous phase I.

The alcohols used are, in particular, ethanol, isopropanol and n-propanol. Suitable ether alcohols are sufficiently water-soluble compounds containing up to 10 carbon atoms in the molecule. Examples of such ether alcohols are ethylene glycol monobutyl ether, propylene glycol monobutyl ether, diethylene glycol monobutyl ether, propylene glycol monotert.-butyl ether and propylene glycol monoethyl ether, of which ethylene glycol monobutyl ether and propylene glycol monobutyl ether are preferred. If alcohol and ether alcohol are used alongside one another, the ratio by weight between them is preferably from 1:2 to 4:1. According to the invention, ethanol is particularly preferred.

The compositions can be converted into the temporary emulsion according to the invention by shaking preferably up to three times, more preferably twice and most preferably once, the temporary emulsion produced by shaking remaining stable (i.e. on the one hand not collapsing immediately after the end of shaking but, on the other hand, not remaining in tact for too long) for a time long enough for convenient application of the composition of about 0.5 to 10 mins., preferably 1 to 5 mins. and most preferably 1.5 to 4 mins. In the present context, stable means that at least 90% by volume of the composition is still present as the temporary emulsion produced by shaking after the particular period of time. Apart from the choice of the basic and active components and the quantities used, another way of establishing the stable property of the composition according to the invention is to control the viscosity of the individual phases.

The aqueous phase I preferably has a Brookfield viscosity (Model DV-II+, spindle 31, rotation frequency 20 $m^{-1}$, 20° C.) of 0.1 to 200 mPa·s, more preferably in the range from 0.5 to 100 mPa·s and most preferably in the range from 1 to 60 mPa·s. To this end, the composition or rather its phases may contain viscosity regulators. The quantity of viscosity regulator in phase I, based on phase I, is normally up to 0.5% by weight, preferably between 0.001 and 0.3% by weight, more preferably between 0.01 and 0.2% by weight and most preferably between 0.05 and 0.15% by weight. Suitable viscosity regulators are inter alia synthetic polymers, such as the homopolymers and/or copolymers of acrylic acid and derivatives thereof, for example the products obtainable under the name of Carbopol® from Goodrich, more particularly the crosslinked acrylic acid copolymer Carbopol-ETD-2623®. International patent application WO 97/38076 mentions a number of other polymers derived from acrylic acid which also represent suitable viscosity regulators.

The compositions according to the invention may additionally contain volatile alkali in phase I. Ammonia and/or alkanolamines which may contain up to 9 carbon atoms in the molecule is/are preferably used as the volatile alkali. Preferred alkanolamines are the ethanolamines, preferably monoethanolamine. The ammonia and/or alkanolamine content, based on phase I, is preferably between 0.01 and 3% by weight, more preferably between 0.02 and 1% by weight and most preferably between 0.05 and 0.5% by weight.

Besides the volatile alkali, the compositions according to the invention may additionally contain carboxylic acid in phase I, the equivalent ratio of amine and/or ammonia to carboxylic acid preferably being between 1:0.9 and 1:0.1. Carboxylic acids containing up to 6 carbon atoms, which may be mono-, di- or polycarboxylic acids, are suitable. Depending on the equivalent weight of amine and carboxylic acid, the carboxylic acid content is preferably between 0.01 and 2.7% by weight and more preferably between 0.01 and 0.9% by weight. Examples of suitable carboxylic acids are acetic acid, glycolic acid, lactic acid, citric acid, succinic acid and adipic acid, of which acetic acid, citric acid and lactic acid are preferably used. Acetic acid is particularly preferred.

In a preferred embodiment of the composition according to the invention, the use according to the invention and the process according to the invention, at least one naphthalene sulfonic acid/formaldehyde condensate is used together with at least one other additive which also reduces the rain and/or film effect. This other additive may be one or more water-soluble additives and/or one or more additives which for the most part are dissolved in the non-aqueous phase II of a composition according to the invention.

Other additives in the context of this particular embodiment, which are largely dissolved in the aqueous phase I of a composition according to the invention, are in particular (i) the substantive polymers containing hydrophilic groups according to WO 96/04358 A1 (Procter & Gamble), more particularly polycarboxylates, such as poly (vinyl pyrrolidone-co-acrylic acid), but also poly(styrene sulfonate), cationic sugar and starch derivatives and block copolymers of ethylene oxide and propylene oxide, with an average molecular weight of 10,000 to 3,000,000 g/mole, preferably 20,000 to 2,500,000 g/mole, more preferably 300,000 to 2,000,000 g/mole and most preferably 400,000 to 1,500,000 g/mole, (ii) the amine oxide polymers, more particularly poly(4-vinylpyridine-N-oxides), according to WO 97/33963 A1 (Procter & Gamble) with an average molecular weight of 2,000 to 100,000 g/mole, preferably 5,000 to 20,000 g/mole and more preferably 8,000 to 12,000 g/mole, (iii) end-capped polyalkoxylated alcohols corresponding to the formula:

$$R^1O[CH_2CH(CH_3)O]_p[CH_2CH(R^2)O]_qR^3$$

in which $R^1$ is a linear aliphatic hydrocarbon radical containing 1 to about 22 carbon atoms or a mixture of various such radicals, $R^2$ is a hydrogen atom or a lower alkyl group containing 1 to 6 carbon atoms, $R^3$ is a linear or branched, saturated or unsaturated, aliphatic, optionally aryl-substituted, acyclic or cyclic hydrocarbon radical containing 1 to about 78 carbon atoms and optionally one or more hydroxy groups and/or ether groups —O— or a mixture of various such radicals, p is a number of 0 to about 15 and q is a number of 0 to about 50, the sum of p and q being at least 1, more particularly epoxy-end-capped polyalkoxylated alcohols corresponding to the above formula, in which $R^1$ is a linear aliphatic hydrocarbon radical containing about 4 to about 18 and preferably about 4 to about 12 carbon atoms, more particularly a butyl, hexyl, octyl or decyl radical or mixtures thereof, or a mixture of various such radicals, $R^2$ is a hydrogen atom or a lower alkyl group containing 1 to 6 carbon atoms, preferably a hydrogen atom, $R^3$ is a group $[CH_2CH(R^4))]_rH$, where $R^4$ is a linear aliphatic hydrocarbon radical containing about 2 to about 26, preferably about 4 to about 18 and more preferably about 6 to about 14 carbon atoms or a mixture of various such radicals and r is a number of 1 to about 3, preferably 1 to about 2, more preferably 1, p is a number of 1 to about 5, preferably 1 to about 2 and more preferably 1 and q is a number of 1 to about 30, preferably about 4 to about 26 and more preferably about 10 to about 24, for example with $R^1=C_{8/10}$ alkyl group, $R^2=H$, $R^3=[CH_2CH(R^4)O]_rH$ with $R^4=C_8$ alkyl group and r=1, u=1 and v=22, (iv) lignin sulfonates, for example the alkali metal and alkaline earth metal lignin sulfonates and the ammonium lignin sulfonates or mixtures thereof, preferably sodium, magnesium, calcium or ammonium lignin sulfonates and mixtures thereof, more particularly the sodium lignin sulfonates, and/or lignin sulfonic acid optionally neutralized in situ with a corresponding base (suitable lignin sulfonates are commercially obtainable, for example, under the name of Zewa® from Ligninchemie, for example the sodium lignin sulfonates Zewa® EF, Zewa® S, Zewa® S2, Zewa® SL and Zewa® SL 2 and the ammonium lignin sulfonate Zewa® DIS TR, under the name of Totanin® from Nike Baeck Industries GmbH, for example the ammonium lignin sulfonate Totanin® AM 5025-T2 and the calcium lignin sulfonate Totanin® CA 2032, and under the name of Borresperse® (about 25% of the molecules have a molecular weight above 20,000 g/mole), Borrewell®, Borrebond®, Ultrazine®, Ufoxane® (Ultrazine®, Ufoxane®: about 40% of the molecules have a molecular weight above 20,000 g/mole), Marasperse®, Maracell® and Maratan® from Ligno Tech USA, Inc., the Borregard group, for example the calcium lignin sulfonates Borresperse® CA, Borrebond® and Ultrazine® CA, the sodium lignin sulfonates Borresperse® NA, Borresperse® 3A, Ultrazine® NA, Ultrazine® NAS, Ufoxane® 2, Ufoxane® 3A and Ufoxane® RG, the ammonium lignin sulfonate Borresperse® NH and the chromium, ferrochromium and iron lignin sulfonates Borresperse® C, FC and FE, (v) high molecular weight to low molecular weight, preferably low molecular weight, naphthalene sulfonic acid/formaldehyde condensates and salts thereof, for example the alkali metal and alkaline earth metal salts, preferably the sodium, potassium, magnesium and calcium salts, and the ammonium salts or mixtures thereof, more particularly the sodium salts (suitable naphthalene sulfonic acid/formaldehyde condensates are commercially obtainable, for example, under the name of Lomar® from Henkel Corp., for example the low molecular weight sodium salts Lomar® LS, Lomar® PW, Lomar® PWFA 40 and Lomar® PL 4, the high molecular weight sodium salts Lomar® D and Lomar® D SOL, the potassium salt Lomar® HP and the ammonium salt Lomar® PWA, and under the name of Tamol® from BASF AG, for example the low molecular weight condensates Tamol® NN 2901, Tamol® NN 7718, Tamol® NN 8906, Tamol® NN 9104, Tamol® NN 9401 (all sodium salts) and Tamol® NNA 4019 (ammonium salt) with a molecular weight of about 6,500 g/mole, the medium molecular weight condensates Tamol® NMC 4001 and Tamol® NN 9401 (both calcium salts) with a molecular weight of about 20,000 g/mole and the high molecular weight condensates Tamol® NH 3091, Tamol® NH 7519, Tamol® NH 9103 (all sodium salts) and Tamol® NHC 3001 (calcium salt) with a molecular weight of about 35,000 g/mole), (vi) gum arabic, (vii) polyvinyl pyrrolidones and (viii) polyethylene glycols, the polywaxes, solid polyethylene glycols with a molecular weight of ca. 500 to >100,000 g/mole, for example 4,000 g/mole, and a wax-like consistency, being preferred to the liquid polyethylene glycols with a molecular weight of, for example, 200 g/mole.

Other additives in the context of this particular embodiment, which are dissolved largely in the non-aqueous phase II of a composition according to the invention, are in particular alkoxylated aromatic dihydroxy compounds corresponding to formula A:

(A)

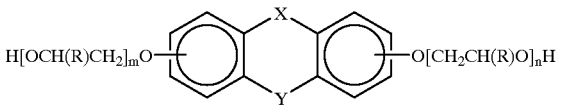

in which X is a single bond, a $C_{1-5}$ alkylene group, a carbonyl group or a group C—$R^1$, where $R^1$ is a hydrogen atom or a $C_{1-6}$ alkyl group, Y is a single bond, a $C_{1-5}$ alkylene group, a carbonyl group, a group C—$R^2$, where $R^2$ is a hydrogen atom or a $C_{1-6}$ alkyl group, or two hydrogen atoms, the group "—Y—" then corresponding to "—H H—", R is a hydrogen atom, a $C_{1-6}$ alkyl group or mixtures thereof, m is a number of 0 to about 20 and n is a number of 0 to about 20 and the sum of m+n>0. The quantity of alkoxylated aromatic dihydroxy compound is determined by its solubility in the non-aqueous phase II, alkoxylated aromatic dihydroxy compound preferably being used in no more than the quantity which dissolves homogeneously in the non-aqueous base of phase II. Particularly preferred alkoxylated aromatic dihydroxy compounds have a high solubility in aliphatic gasoline hydrocarbons which, as described hereinafter, represent a preferred base for the non-aqueous phase II. Suitable aromatic parent compounds of the alkoxylated aromatic dihydroxy compounds, i.e. formula A without the groups $H[OCH(R)CH_2]_mO$— and —$O[CH_2CH(R)]_nH$, are for example biphenyl, diphenyl methane, 1,1-diphenylethane, 1,2-diphenylethane, 1,2-diphenylpropane, 1,3-diphenylpropane, 2,2-diphenylpropane, 1,2-diphenylbutane, 1,4-diphenylbutane, 2,2-diphenylbutane, 1,5-diphenylpentane, 3,3-diphenylpentane, fluorene, fluorenone, anthracene and anthraquinone. Known aromatic dihydroxy compounds, of which the alkoxylates represent compounds of formula A according to the invention, are for example o,o'-biphenol and the bisphenols bisphenol A (2,2-bis-(4-hydroxyphenyl)-propane), bisphenol B (2,2-bis-(4-hydroxyphenyl)-butane) and bisphenol F (2,2'-methylenediphenol). The alkoxylation of the aromatic dihydroxy compounds to the alkoxylated aromatic dihydroxy compounds of formula A according to the invention can be carried out by known methods of alkoxylation, normally in the presence of an acid or base as catalyst, at elevated temperature and elevated pressure, a normal or narrow homolog distribution being obtained according to the conditions selected. The sum of m+n represents the average total degree of alkoxylation of the alkoxylated aromatic dihydroxy compounds of formula A according to the invention and assumes values in the region of the real numbers of >0 to about 40, m and n at the molecular level standing for corresponding integers of 0 to about 20 according to the particular homolog distribution. The corresponding average degrees of alkoxylation m and n are generally the same whereas, at the molecular level, m and n may be the same or different. Thus, an average total degree of alkoxylation of 13 corresponds to average degrees of alkoxylation m and n of 6.5; in a significant part of the molecules, m=n=6, m=n=7 or m=6 and n=7. The average total degree of alkoxylation is preferably 0.1 to 30, more preferably 0.5 to 25, most preferably 1 to 20 and, in one particularly advantageous embodiment, 1.5 to 15. According to the invention, the ethoxylated and/or propoxylated aromatic dihydroxy compounds of formula A (R=H and/or $CH_3$) are preferred. These may be mixed alkoxylates containing ethyleneoxy (EO) and propyleneoxy units (PO), but are preferably pure ethoxylates or—more particularly—pure propoxylates. However, aromatic dihydroxy compounds of formula A, in which R is an ethyl, propyl, isopropyl, butyl, sec.butyl, tert.-butyl, pentyl and/or hexyl group, may also be used. Preferred aromatic dihydroxy compounds corresponding to formula A contain two hydrogen atoms "—H H—" as the group "—Y—" and bear the alkoxylated hydroxy groups in the 4- and 4'-position in particular (relative to X) in accordance with formula B:

(B)

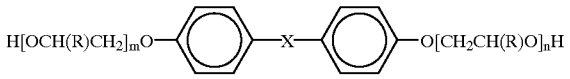

where —X— is preferably a $C_{1-5}$ alkylene group —$C(R^3)(R^4)$—, where $R^3$ and $R^4$=H, $CH_3$, $CH_2CH_3$ or $CH_2CH_2CH_3$, more particularly a 2,2-propylene group or 2,2-butylene group. Alkoxylation products of biphenol A, which is also known by the name of Dianol, corresponding to formula C:

(C)

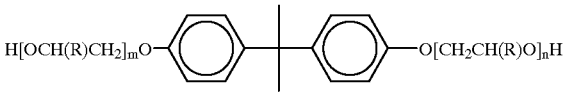

where R is preferably a hydrogen atom and/or a methyl group and m and n are each numbers of 1 to 15 and more particularly 1 to 10, for example R=H and m+n=2, 4, 6.5 or 8.5 or R=$CH_3$and m+n=2, 4 or 13 and more preferably R=$CH_3$ and m+n=13, are particularly preferred. Alkoxylated bisphenols A corresponding to formula C are marketed, for example, under the name of Dianol® by Akzo Nobel, for example Dianol® 22, Dianol® 220, Dianol® 22 D, Dianol® 240 1, Dianol® 264, Dianol® 285, Dianol® 33, Dianol® 320, Dianol® 340, Dianol® 33 and Dianol® 3130.

In a preferred variant of this particular embodiment, at least one naphthalene sulfonic acid/formaldehyde condensate is used together with at least one alkoxylated aromatic dihydroxy compound corresponding to formula A. In another preferred variant of this particular embodiment, at least one naphthalene sulfonic acid/formaldehyde condensate is used together with at least one of the above-mentioned water-soluble additives (i) to (vii). In yet another preferred variant of this particular embodiment, at least one naphthalene sulfonic acid/formaldehyde condensate is used together with at least one alkoxylated aromatic dihydroxy compound corresponding to formula A and at least one of the above-mentioned water-soluble additives (i) to (vii).

The content of at least one of these other additives in a composition according to the invention is 0.001 to 20% by weight, preferably 0.01 to 10% by weight, more preferably 0.05 to 5% by weight, most preferably 0.1 to 1.5% by weight and, in one particularly advantageous embodiment, 0.15 to 0.5% by weight.

Besides the components mentioned, the compositions according to the invention may contain other auxiliaries and additives of the type typically present in such compositions. These include in particular dyes, perfume oils, pH regulators (for example citric acid, alkanolamines or NaOH), preservatives, complexing agents for alkaline earth metal ions, enzymes, bleaching systems and antistatic agents. The quantity of such additives is normally not more than 2% by weight in the cleaning composition. The lower limit to the quantity used depends on the type of additive and, in the case of dyes for example, may be 0.001% by weight or lower. The quantity of auxiliaries used is preferably between 0.01 and 1% by weight.

The pH value of the aqueous phase I may be varied over a broad range, although it is preferably in the range from 2.5 to 12, more preferably in the range from 5 to 10.5 and most preferably in the range from 7 to 10.

In one preferred embodiment, the compositions according to the invention contain 70 to 95% by volume of aqueous phase I containing
- 0.01 to 10% by weight of anionic surfactant,
- 0 to 3% by weight of nonionic surfactant,
- 0.1 to 1.5% by weight of at least one naphthalene sulfonic acid/formaldehyde condensate,
- 0 to 1.5% by weight of other water-soluble additive (i) to (vii) for reducing the rain and/or film effect,
- 0 to 10% by weight of water-soluble organic solvent,
- 0 to 0.5% by weight of viscosity regulator,
- 0 to 3% by weight of volatile alkali,
- 0 to 0.2% by weight of perfume and
- to 100% by weight water, and 5 to 30% by volume of non-aqueous phase II containing
- 0 to 100% by weight of aliphatic gasoline hydrocarbons,
- 0 to 100% by weight of terpene hydrocarbons,
- 0 to 5% by weight of at least one alkoxylated aromatic dihydroxy compound corresponding to formula A,
- 0 to 5% by weight of nonionic surfactant and
- 0 to 1% by weight of perfume, the % by weight being based on the particular phase, the sum of the gasoline and terpene hydrocarbons completing phase II to 100% by weight and the phases optionally containing small amounts of dye.

The composition according to the invention is sprayable and, accordingly, may be used in a spray dispenser.

Accordingly, the present invention also relates to a product containing a composition according to the invention and a spray dispenser.

The spray dispenser is preferably a hand-operated spray dispenser, more particularly selected from the group consisting of aerosol spray dispensers, self-pressure-generating spray dispensers, pump spray dispensers and trigger spray dispensers, more particularly pump spray dispensers and trigger spray dispensers with a container of transparent polyethylene or polyethylene terephthalate. Spray dispensers are described in more detail in WO 96/04940 (Procter & Gamble) and the US patents cited therein on the subject of spray dispensers, to which reference is made in this connection and of which the disclosure is hereby incorporated in the present application.

The compositions according to the invention are used, for example, by applying the composition temporarily converted into an emulsion by shaking to the surface to be cleaned in quantities of about 1.5 to 10 g per $m^2$ and, more particularly, 3 to 7 g per $m^2$ and immediately wiping the surface with a soft absorbent material and thus cleaning the surface. The compositions are preferably applied by suitable spray applicators, more particularly a spray dispenser or a product according to the invention, in order to obtain uniform distribution. Sponges or cloths in particular are suitable for wiping and may be periodically rinsed out with water in the cleaning of relatively large surfaces.

The compositions according to the invention are prepared by separate mixing of the individual phases directly from their raw materials, subsequent combining and intermixing of the phases and, in a final step, leaving the composition to stand in order to separate the temporary emulsion. They may also be prepared by mixing directly from their raw materials, subsequent intermixing and, in a final step, leaving the composition to stand in order to separate the temporary emulsion. If a component is not completely insoluble in a phase other than the phase to which the particular component was assigned or with which it was introduced into the composition, this other phase may also contain corresponding parts of the particular component in the adjustment of solubility equilibria by diffusion.

EXAMPLES

Compositions E1 to E3 according to the invention and comparison composition C1 were prepared simply by stirring the components listed in Table 1 together. E1 to E3 contained the naphthalene sulfonic acid/formaldehyde condensate Lomar® LS in various quantities whereas C1 contained no additive. $C_{9-13}$ isoparaffins were used as the aliphatic gasoline hydrocarbon All the compositions had a pH value of 10 and contained a clear and transparent aqueous phase 1 has lower phase and a creamy whitish non-aqueous phase II as upper phase in a ratio by volume at of phase I to phase II of 80:20, the two phases being separated by a sharp interface. The aqueous phase I was slightly thickened by the polymer so that the temporary emulsions produced by shaking remained stable long enough for convenient application of the composition (about 3 mins.) and then re-separated into their phases.

TABLE 1

| Composition [% by weight] | E1 | E2 | E3 | C1 |
|---|---|---|---|---|
| Naphthalene sulfonic acid/ formaldehyde condensate | 0.1 | 0.2 | 0.4 | — |
| Sodium $C_{12-14}$ fatty alkyl sulfate | 0.25 | 0.25 | 0.25 | 0.25 |
| Ethanol | 5 | 5 | 5 | 5 |
| Crosslinked acrylic acid copolymer | 0.02 | 0.02 | 0.02 | 0.02 |
| Aliphatic gasoline hydrocarbon | 15 | 15 | 15 | 15 |
| Aqueous ammonia solution, 25% by wt. | 0.2 | 0.2 | 0.2 | 0.2 |
| Water | to 100 | to 100 | to 100 | to 100 |

Testing of Anti-film and Anti-rain Effect

First, quantifies of 2 ml of the particular composition were applied to a mirror measuring 30 cm×60 cm using a folded nonwoven measuring 20 cm×20 cm (Chicopee, Duralace 60), after which the mirror was polished in the usual way. After 30 minutes, a second identical treatment was carried out. Another 30 minutes later, the anti-film effect and anti-rain effect were tested as follows.

Anti-film Effect.

The treated mirror was held for 5 seconds over a bowl (28 cm×50 cm×4 cm) containing 1.5 liters of boiling water and was evaluated immediately afterwards to determine whether it was covered with film and, if so, how thick the film was.

Anti-rain effect.

Ca. 10 g of test rain prepared from tap water and 8 g/l of wfk-carpet pigment soil (55% by weight kaolin, 43% by weight quartz, 1.5% by weight lamp black (Flammruβ 101), 0.5% by weight iron oxide black; wfk-Code wfk-09 W) of the wkf-Testgewebe GmbH (http://www/wkf.de) were uniformly sprayed onto the pretreated mirror surface over a period of about 4 seconds from a pump spray bottle. Immediately afterwards, evaluations were made of wetting and droplet formation and—after drying—soil distribution and stain formation.

The evaluation was made visually by a panel of five people who were each instructed to award scores of 1 to 4 to the four compositions in order of decreasing effectiveness. The particular average value is shown as a score in Table 2 together with an assessment. The lower the score, the better the particular effect.

TABLE 2

| Effect Composition | Score | Assessment |
|---|---|---|
| | | Anti-film effect |
| E1 | 3 | Little effect |
| E2 | 2 | Good protection against film formation |
| E3 | 2 | Good protection against film formation |
| C1 | 3 | Little effect |
| | | Anti-rain effect Overall impression of the wet mirror |
| E1 | 2.5 | Good wetting, few droplets |
| E2 | 1.7 | Very good wetting, hardly any droplets |
| E3 | 1.7 | Very good wetting, hardly any droplets |
| C1 | 4.0 | Good wetting, breaks up quickly |

TABLE 2-continued

| Effect Composition | Score | Assessment |
|---|---|---|
| | | Anti-rain effect Overall impression of the dry mirror |
| E1 | 3.0 | Slightly better soil distribution than C1 |
| E2 | 2.2 | Soil uniformly distributed, hardly any stains |
| E3 | 2.0 | Soil uniformly distributed, no stains |
| C1 | 4.0 | Some stains and "drainage marks", soil only uniform in the upper part |

In contrast to C1, compositions E1 to E3 according to the invention show both an anti-rain effect and an anti-film effect.

What is claimed is:

1. A liquid multiphase cleaning composition comprising:

a) a continuous aqueous phase I; and b) a continuous non-aqueous phase II immiscible with said aqueous phase, wherein said composition can be temporarily converted into an emulsion by shaking, wherein said composition comprises at least one naphthalene sulfonic acid/formaldehyde condensate, and wherein said composition further comprises an emulsion phase between the continuous phases I and II, wherein the emulsion phase comprises an emulsion of one of the two phases in the other phase, and wherein said emulsion phase is demarcated by a sharp upper interface and a sharp lower interface from those parts of phases I and II which are not involved in said emulsion.

2. The composition of claim 1, comprising 0.001 to 20 percent by weight of at least one naphthalene sulfonic acid/formaldehyde condensate.

3. The composition of claim 2, comprising 0.01 to 10 percent by weight of at least one naphthalene sulfonic acid/formaldehyde condensate.

4. The composition of claim 3, comprising 0.1 to 1.5 percent by weight of at least one naphthalene sulfonic acid/formaldehyde condensate.

5. The composition of claim 4, comprising 0.15 to 0.5 percent by weight of at least one naphthalene sulfonic acid/formaldehyde condensate.

6. The composition of claim 1 having a sharp interface between continuous phases I and II.

7. The composition of claim 1 wherein part of one or both continuous phases is contained as a dispersant in the other phase.

8. The composition of claim 7 wherein from 0.1 to 35 percent by volume of one or both continuous phases is contained as a dispersant in the other phase.

9. The composition of claim 8 wherein from 0.2 to 20 percent by volume of one or both continuous phases is contained as a dispersant in the other phase.

10. The composition of claim 1 comprising 35 to 95 percent by volume of phase I, and 5 to 65 percent by volume of phase II.

11. The composition of claim 10 comprising 55 to 95 percent by volume of phase I, and 5 to 45 percent by volume of phase II.

12. The composition of claim 11 comprising 70 to 95 percent by volume of phase I and 5 to 30 percent by volume of phase II.

13. The composition of claim 1 wherein said non-aqueous phase II comprises aliphatic gasoline hydrocarbons, terpene hydrocarbons, or mixtures thereof.

14. The composition of claim 13 wherein said aliphatic gasoline hydrocarbons have a boiling range of 130 to 260° C.

15. The composition of claim 13 wherein said terpene hydrocarbons comprise orange oil, pine oil, or mixtures thereof.

16. The composition of claim 13 wherein said aliphatic gasoline hydrocarbons comprise 60 to 99.99 percent by weight of said non-aqueous phase II and have a boiling range of 140 to 220° C.

17. The composition of claim 16 wherein said aliphatic gasoline hydrocarbons comprise 90 to 99.9 percent by weight of said non-aqueous phase II.

18. The composition of claim 17 wherein said aliphatic gasoline hydrocarbons comprise 95 to 99.9 percent by weight of said non-aqueous phase II.

19. The composition of claim 18 wherein said aliphatic gasoline hydrocarbons comprise 97 to 99 percent by weight of said non-aqueous phase II.

20. The composition of claim 16 wherein said aliphatic gasoline hydrocarbons have a boiling range of 150 to 200° C.

21. The composition of claim 1 wherein said non-aqueous phase II consists of aliphatic gasoline hydrocarbons, terpene hydrocarbons, or mixtures thereof.

22. The composition of claim 1 further comprising an anionic surfactant, nonionic surfactant, or a mixture thereof.

23. The composition of claim 22 comprising 0.01 to 5 percent by weight of anionic surfactant.

24. The composition of claim 23 comprising 0.01 to 0.5 percent by weight of anionic surfactant.

25. The composition of claim 24 comprising 0.1 to 0.3 percent by weight of anionic surfactant.

26. The composition of claim 22 comprising 0.001 to 0.5 percent by weight of nonionic surfactant.

27. The composition of claim 26 comprising 0.005 to 0.1 percent by weight of nonionic surfactant.

28. The composition of claim 27 comprising 0.01 to 0.05 percent by weight of nonionic surfactant.

29. The composition of claim 22 comprising an anionic surfactant selected from the group consisting of $C_{8-18}$ alkyl benzenesulfonates, $C_{8-20}$ alkane sulfonates, $C_{8-18}$ monoalkyl sulfates, $C_{8-18}$ alkyl polyglycol ether sulfates containing 2 to 6 ethylene oxide units, $C_{8-18}$ alkyl alcohol/sulfosuccinic acid esters, and mixtures thereof.

30. The composition of claim 22 comprising a nonionic surfactant selected from the group consisting of ethoxylates of $C_{8-18}$ alcohols, alkyl polyglycosides, and mixtures thereof.

31. The composition of claim 22 comprising an anionic surfactant in phase I, and a nonionic surfactant in phase II.

32. The composition of claim 31 comprising a $C_{12-14}$ fatty alcohol sulfate, a $C_{12-14}$ fatty alcohol polyglycol ether sulfate, or a mixture thereof in phase I, and a $C_{16-18}$ fatty alcohol polyglycol ether, a $C_{14-18}$ fatty acid polyglycol ester, or a mixture thereof in phase II.

33. The composition of claim 32 wherein said $C_{12-14}$ fatty alcohol polyglycol ether sulfate contains 2 ethylene oxide units (EO).

34. The composition of claim 32 wherein said $C_{16-18}$ fatty alcohol polyglycol ether contains 2 to 8 EO units and said $C_{14-18}$ fatty acid polyglycol ester contains 2 to 10 EO units.

35. The composition of claim 1 wherein phase I comprises from 0.1 to 15 percent by weight based on phase I of water-soluble organic solvents.

36. The composition of claim 35 wherein phase I comprises from 1 to 10 percent by weight based on phase I of water-soluble organic solvents.

37. The composition of claim 1 comprising water-soluble organic solvents selected from the group consisting of lower alcohols containing 2 or 3 carbon atoms, ether alcohols, ethylene glycol monobutyl ether, polypropylene glycol monobutyl ether, and mixtures thereof.

38. The composition of claim 1 comprising in phase I up to 0.5 percent by weight based on phase I of viscosity regulators.

39. The composition of claim 38 comprising in phase I from 0.001 to 0.3 percent by weight based on phase I of viscosity regulators.

40. The composition of claim 39 wherein phase I comprises from 0.05 to 0.15 percent by weight based on phase I of viscosity regulators.

41. The composition of claim 38 wherein said viscosity regulators comprise homopolymers and/or copolymers of acrylic acid or salts thereof.

42. The composition of claim 1 wherein phase I has a viscosity of 0.1 to 200 mPa·s.

43. The composition of claim 42 wherein phase I has a viscosity of 0.5 to 100 mPa·s.

44. The composition of claim 43 wherein phase I has a viscosity of 1 to 60 mPa·s.

45. The composition of claim 1 wherein phase I comprises 0.01 to 3 percent by weight based on phase I of volatile alkali.

46. The composition of claim 45 wherein said volatile alkali comprises ammonia, alkanolamine containing up to 9 carbon atoms, or a mixture thereof.

47. The composition of claim 45 wherein phase I comprises 0.02 to 1 percent by weight based on phase I of volatile alkali.

48. The composition of claim 47 wherein phase I comprises 0.05 to 0.5 percent by weight based on phase I of volatile alkali.

49. The composition of claim 1 further comprising an alkoxylated aromatic dihydroxy compound.

50. The composition of claim 1 comprising:

a) 70 to 95 percent by volume of aqueous phase I comprising:
   1) 0.01 to 10 percent by weight of an anionic surfactant;
   2) 0 to 3 percent by weight of a nonionic surfactant;
   3) 0.1 to 1.5 percent by weight of at least one naphthalene sulfonic acid/formaldehyde condensate;
   4) 0 to 1.5 percent by weight of a water-soluble additive for reducing the rain and/or film effect;
   5) 0 to 10 percent by weight of a water-soluble organic solvent;
   6) 0 to 0.5 percent by weight of a viscosity regulator;
   7) 0 to 3 percent by weight of a volatile alkali,
   8) 0 to 0.2 percent by weight of a perfume; and
   9) water in an amount to complete phase I to 100 weight percent; and b) 5 to 30 percent by volume of non-aqueous phase II comprising:
   1) 0 to 100 percent by weight of aliphatic gasoline hydrocarbons;
   2) 0 to 100 percent by weight of terpene hydrocarbons;
   3) 0 to 5 percent by weight of at least one alkoxylated aromatic dihydroxy compound corresponding to formula A:

(A)

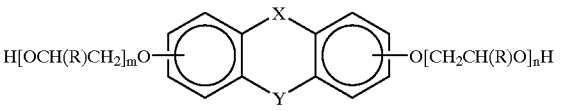

wherein X is a single bond, a C1–5 alkylene group, a carbonyl group or a group C—R1, wherein R1 is a hydrogen atom or a C1–6 alkyl group, Y is a single bond, a carbonyl group or a group C—R2, wherein R2 is a hydrogen atom or a C1–6 alkyl group, or two hydrogen atoms, the group "Y" then corresponding to "—H H—", R is a hydrogen atom, a C1–6 alkyl group or mixtures thereof, m is a number of 0 to about 20, and n is a number of 0 to about 20, and the sum of m+n>0;

4) 0 to 5 percent by weight of a nonionic surfactant; and 5) 0 to 1 percent by weight of a perfume, wherein the sum of the aliphatic gasoline and terpene hydrocarbons complete phase II to 100%.

51. The composition of claim 50 wherein one or both of the phases further comprise a dye.

52. A process for cleaning hard surfaces, comprising;

a) forming the cleaning composition of claim 1;

b) converting said cleaning composition into a temporary emulsion by shaking; and c) apply said emulsion to a surface to be cleaned in quantities of 1.5 to 10 g per $m^2$.

53. The process of claim 52 wherein the surface is glass.

54. The process of claim 52 wherein the emulsion is applied to the surface by spraying.

55. The process of claim 52 further comprising wiping said surface with a soft absorbent material following application of said emulsion.

56. The process of claim 52 producing a surface with reduced rain effect and/or film effect.

57. A product containing the composition of claim 1 in a spray dispenser.

* * * * *